United States Patent [19]

Itakura

[11] Patent Number: 4,862,955

[45] Date of Patent: Sep. 5, 1989

[54] HEAT EXCHANGER

[75] Inventor: Masato Itakura, Toyota, Japan

[73] Assignee: Aisin Seiki Kabushiki Kaisha, Aichi, Japan

[21] Appl. No.: 156,015

[22] Filed: Feb. 16, 1988

[30] Foreign Application Priority Data

Feb. 13, 1988 [JP] Japan ..... 62-20597[U]

[51] Int. Cl.[4] ..... F28D 1/04; F28D 1/06; F01M 1/00

[52] U.S. Cl. ..... 165/155; 165/41; 123/196 AB

[58] Field of Search ..... 165/155, 41, 43; 123/41.01, 196 AB

[56] References Cited

U.S. PATENT DOCUMENTS 4,335,688 6/1982 Diederich, Jr. ..... 123/196 AB X
4,730,666 3/1988 Flint et al. ..... 165/80.4
4,768,580 9/1988 Ferguson ..... 165/41

*Primary Examiner*—Larry Jones
*Attorney, Agent, or Firm*—Oblon, Spivak, McClelland, Maier & Neustadt

[57] ABSTRACT

A heat exchanger for an internal combustion engine includes a first conduit, a second conduit positioned outside of the first conduit, a third conduit positioned inside of the first conduit, a first annular passage formed between the first and second conduits, and a second annular passage formed between the first and third conduits. Heat exchange is performed between a first fluid flowing through the first annular passage and the inside of the third conduit and a second fluid flowing through the second annular passage.

4 Claims, 3 Drawing Sheets

1
2
2a
2b
2c
3
3a
3b
4
5
5a
5b
6
7
8
9
10'
11'
12
13'
15
16
II
III
IV

HEAT EXCHANGER

BACKGROUND OF THE INVENTION

1. Field of the Invention

This invention relates to heat exchanger which is used, for example, for the recovery of exhaust heat and as an oil cooler in an internal combustion engine.

2. Description of the Related Art

A conventional heat exchanger is disclosed in Japanese Utility Model Publication No. 61(1986)-2243 in which an oil cooler includes an oil conduit through which engine oil flows. A portion of the oil conduit is mounted in a tank of the radiator, whereby the engine oil can be cooled by the cooling water. In the oil conduit within the tank there is provided an expanding and contracting body for heat exchanging which is constructed of a material having a temperature-actuated shape memory and which is called a "shape memory alloy". When the engine oil temperature rises above the transition temperature, the body will expand and increase the surface area contacting the oil conduit to increase heat transfer. By adopting the shape memory alloy, heat transfer increases at high temperature times in which increased heat transfer is required. The rate of heat transfer is decreased at low temperature times in which high heat transfer performance is not required.

In the conventional oil cooler, an outer conduit is positioned outside of an inner conduit through which a first fluid flows. A second fluid flows through an annular chamber formed between the inner conduit and the outer conduit, whereby heat exchange occurs between the first fluid and the second fluid flowing through the inner conduit and the outer conduit, respectively.

In the above conventional art, however, in order to increase the heat transfer area it is necessary to lengthen the conduit in the axial direction, and so the space provided for the heat exchanger limits the heat exchange capacity thereof. This is true for both finned and non-finned heat exchange tubes.

SUMMARY OF THE INVENTION

Accordingly, it is an object of the present invention to provide a new and improved heat exchanger.

More specifically, it is an object of the present invention to provide a heat exchanger in which the heat transfer area can be enlarged within a limited space for the heat exchanger.

In one illustrative embodiment of the present invention, there is provided a heat exchanger which includes a first conduit, a second conduit positioned outside of the first conduit, a first annular passage formed between the first and second conduits, a third conduit positioned inside of the first conduit, and a second annular passage formed between the first and third conduits. Heat exchange is performed between a first fluid flowing through the first annular passage and through an inside of the third conduit and a second fluid flowing through the second annular passage.

BRIEF DESCRIPTION OF THE DRAWINGS

Further objects and advantages of the present invention will become apparent from the following description of a preferred embodiment taken in conjunction with the accompanying drawings, wherein.

DETAILED DESCRIPTION OF THE PREFERRED EMBODIMENT

Figure 1:
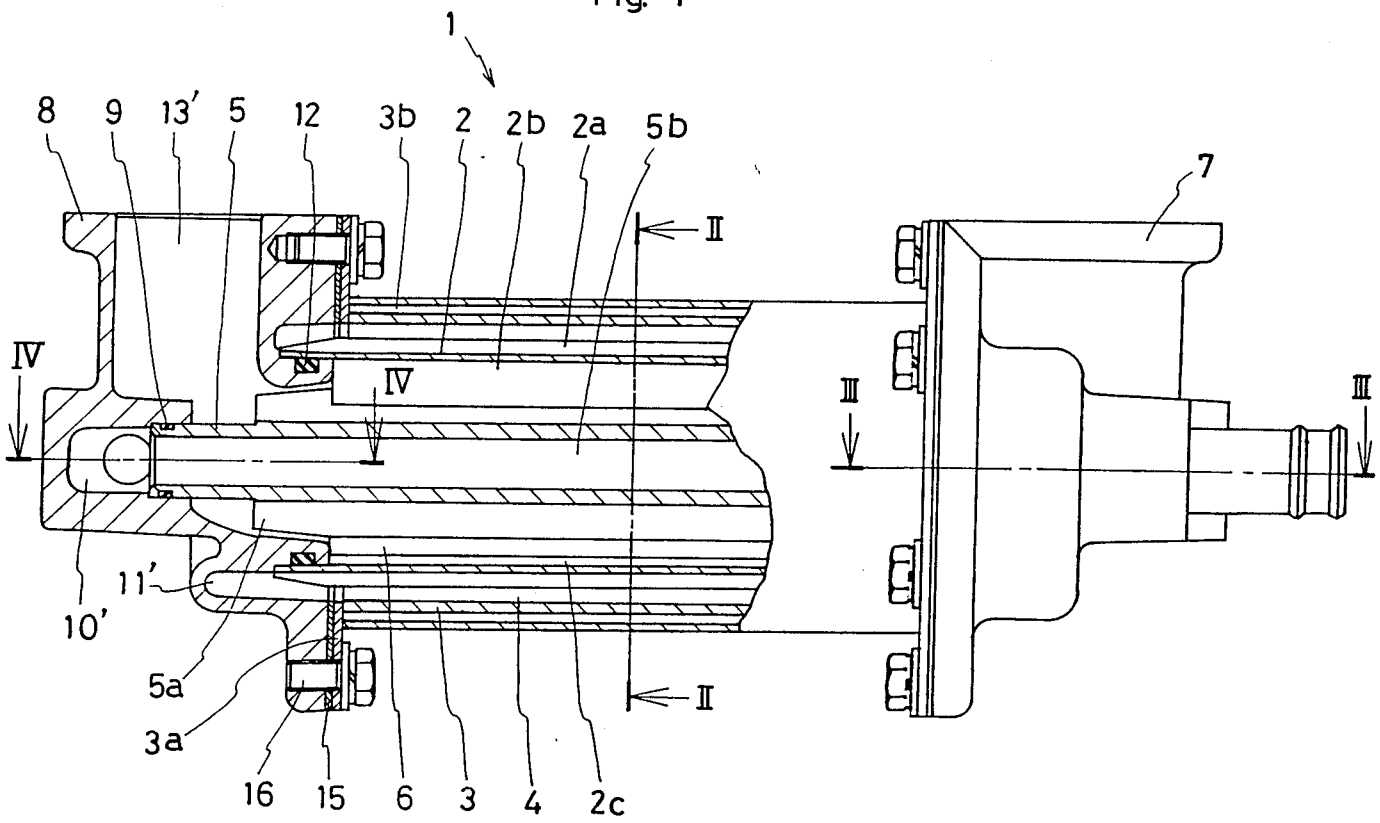
FIG. 1 is a sectional view of a heat exchanger in accordance with one illustrative embodiment of the present invention.
Figure 2:
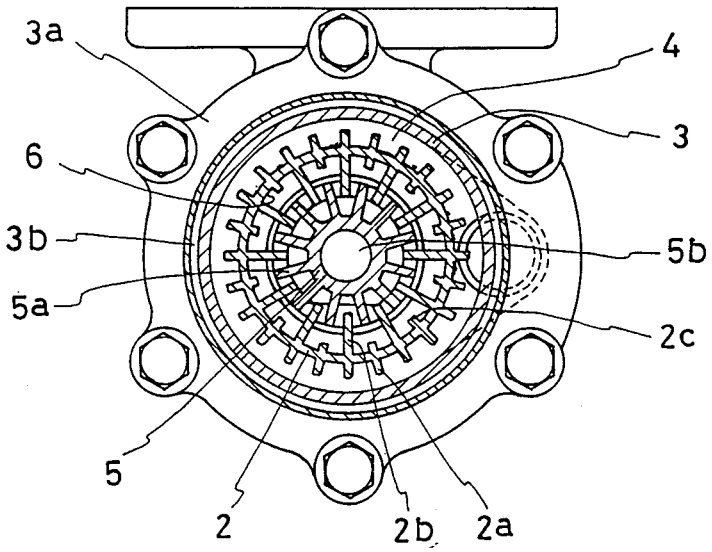
FIG. 2 is a sectional view taken along the line II—II of FIG. 1.

As shown in FIG. 1–4, a heat exchanger 1 includes a first conduit 2 made of an extruded aluminum material. The first conduit is provided with longitudinal fins 2*a* on the outer circumferential surface thereof and both long longitudinal fins 2*b* and short longitudinal fins 2C on the inner circumferential surface thereof. A second conduit 3 is positioned outside of the first conduit 2, and therefore a first annular passage 4 is formed between the first and second conduits 2, 3. The second conduit 3 is made of a usual steel pipe, and a flange 3*a* is connected with the second conduit 3 by welding. The second conduit 3 is further provided with an adiabatic layer (e.g. air layer) 3*b* in order to minimize heat transfer to the outside. Positioned inside of the first conduit 2 is a third conduit 5 which is provided with longitudinal fins 5*a* arranged so that the fins 5*a* and the fins 2*b* may radially overlap each other.

The third conduit 5 is made of an extruded aluminum material. Furthermore, a second annular passage 6 is formed between the first conduit 2 and the third conduit 5. A first body 7 and a second body 8 made of die cast aluminum are respectively installed on the two ends of the conduit group consisting of the first, second and third conduit, respectively.

Figure 3:
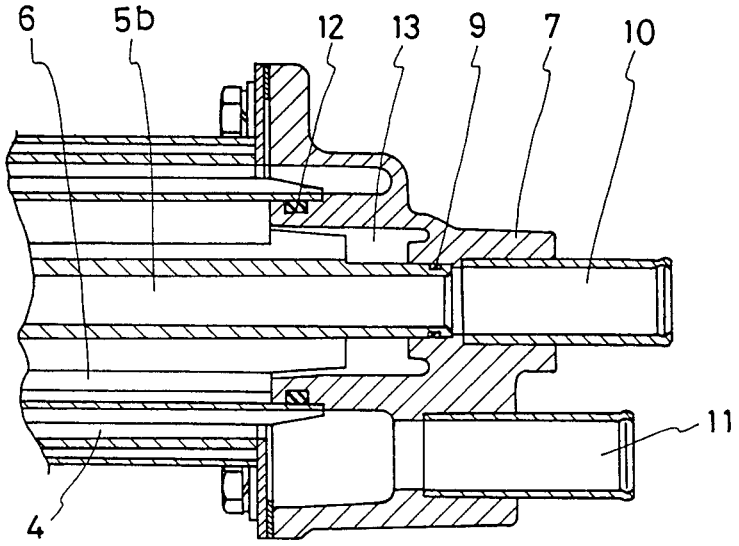
FIG. 3 is a sectional view taken along the line III—III of FIG. 1.

As shown in FIG. 3, the first body 7 is provided with a fluid passage 10 connected with an inner passage 5*b* of the third conduit 5, the joint between conduit 5 and first and second bodies 7 and 8, being sealed via O-rings 9. A fluid passage 11 is connected with the first annular passage 4, and a fluid passage 13 having a port leading to the outside is connected with the second annular passage 6. The first conduit 2 is sealed to the first and second bodies 7 and 8 via O-rings 12.

Figure 4:
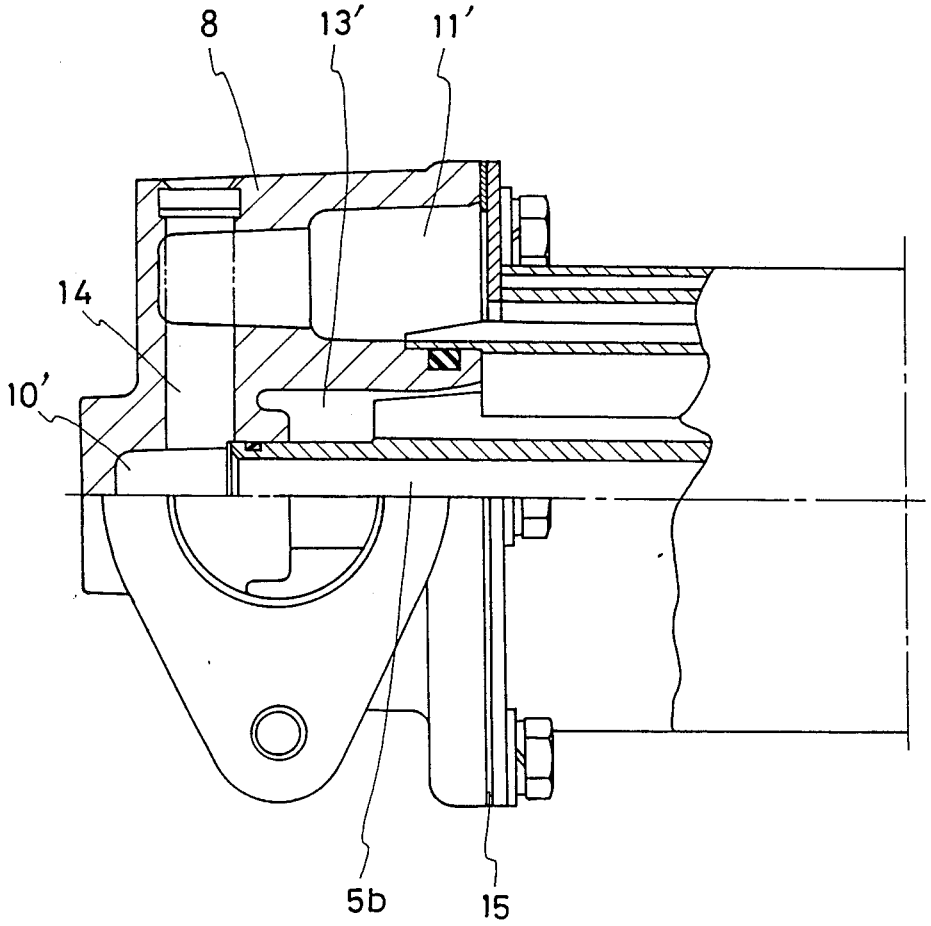
FIG. 4 is a sectional view taken along the line IV—IV of FIG. 1.

As shown in FIGS. 1 and 4, the second body 8 is provided with fluid passages 10', 11', 13' corresponding to the fluid passages 10, 11, 13 of the first body 7. However, instead of having ports leading to the outside, as do the fluid passages 10 and 11 of first body 7, the second body 8 is instead provided with a fluid passage 14 connecting the passages 10' and 11' with each other so that fluid may flow between passages 4 and 5*b*. The flange 3*a* is fixed to the first and second bodies 7, 8 via a gasket 15 and by means of a bolt 16.

In operation, a first fluid (for example, water) flows from the fluid passage 11 of the first body 7 to the inner passage 5*b* of the third conduit 5 via the first annular passage 4 and the fluid passages 11', 14, 10' of the second body 8, and exhaust from fluid passage 10 of the first body 7. A second fluid (for example, oil) flows in through the fluid passage 13, through the second annular passage 6 and exhausts from the fluid passage 13' of the second body 8.

There is a difference in temperature between the first fluid and the second fluid. At the region of the longitudinal fins 2*a*, 2*b*, 5*a*, heat exchange is performed through both the first and third conduits 2, 5 which acts as heat transfer walls. It goes without saying that the flowing direction of the first and second fluids may be reversed according to design conditions. The number and the length of the longitudinal fins are determined by the physical properties and the velocity of flow of the first and second fluids.

Thus, since the third conduit 5 is positioned inside of the first conduit 2, the heat transfer area between the first and second fluids can be enlarged without changing the size of the device in comparison with the prior art device. By positioning the longitudinal fins 2*b* and 5*a* to alternately project into the second annular passage 6, the heat transfer area can be effectively enlarged. Furthermore, when the first and second conduits are made of an extruded material, a spacing between the adjoining fins of a given conduit can be also enlarged due to the overlapping of fins 2*b* and 5*a*, whereby a life span of an extruding die can be prolonged.

Inasmuch as the present invention is subject to many variations, modifications and changes in detail, it is intended that all matter contained in the foregoing description or shown in the accompanying drawing shall be interpreted as illustrative and not in a limiting sense.

What is claimed as new and desired to be secured by Letters Patent of the United States is:

1. A heat exchanger comprising:

a first conduit;

a second conduit positioned outside of said first conduit to form a first annular passage therebetween;

a third conduit positioned inside of said first conduit to form a second annular passage therebetween; means for fluidically connecting ends of said first annular passage and an inside of said third conduit;

means for permitting a first fluid to flow through both said first annular passage and the inside of said third conduit; and means for permitting a second fluid to flow through said second annular passage, whereby heat exchange may be performed between said first and second fluids through the walls of both said first and third conduits.

2. A heat exchanger set forth in claim 1, wherein said first conduit is provided with first longitudinal fin means on an inner circumferential surface thereof and said third conduit is provided with second longitudinal fin means on an outer circumferential surface thereof.

3. A heat exchanger set forth in claim 2, wherein said first fin means and said second fin means radially overlap each other.

4. A heat exchanger set forth in claim 1, wherein said first and third conduits are made of an extruded material.

* * * * *